US005161445A

United States Patent [19]

Kozyrski et al.

[11] Patent Number: 5,161,445

[45] Date of Patent: Nov. 10, 1992

[54] MEASURING STOP ASSEMBLY

[75] Inventors: Vincent T. Kozyrski, Plainville; Alan R. Peters, Monroe; Claude R. Millett, Plainville, all of Conn.

[73] Assignee: The Fletcher-Terry Company, Farmington, Conn.

[21] Appl. No.: 640,889

[22] Filed: Jan. 14, 1991

[51] Int. Cl.[5] ..... B26D 7/02; B26D 7/26

[52] U.S. Cl. ..... 83/455; 88/468; 88/614; 88/468.7; 269/179

[58] Field of Search ..... 83/468, 468.2, 468.7, 83/455, 456, 614; 269/179, 177, 182

[56] References Cited

U.S. PATENT DOCUMENTS

| | | | |
|---|---|---|---|
| 4,413,542 | 11/1983 | Rempel | 83/455 |
| 4,798,112 | 1/1989 | Kozyrski et al. | 83/455 |
| 4,858,507 | 8/1989 | Evans et al. | 83/455 |
| 4,871,156 | 10/1989 | Kozyrski et al. | 269/303 |

*Primary Examiner*—Hien H. Phan
*Assistant Examiner*—Raymond D. Woods
*Attorney, Agent, or Firm*—Ira S. Dorman

[57] ABSTRACT

Measuring stops for a mat cutting machine are constructed to permit installation without removal of either the shaft on which they are carried or of any element used to mount the shaft on the clamping bar. The stop locking mechanism comprises a pivotable block, which is forced into clamping relationships by a screw assembly; strong locking effect is achieved without overstressing or distortion of the stop body material.

17 Claims, 3 Drawing Sheets

MEASURING STOP ASSEMBLY

BACKGROUND OF THE INVENTION

It is conventional to employ measuring stops on mat cutting machines for quickly and easily locating the starting and ending points of cuts to be made. As described in Kozyrski et al U.S. Pat. No. 4,871,156, issued Oct. 3, 1989, such measuring stops are slidably mounted upon the shaft or rail of the mat clamping bar of the machine, and means is provided on the stop itself for locking it at any selected point along the length of the shaft. Although the measuring stops described by Kozyrski et al are entirely satisfactory for their intended purpose, it has now been recognized that certain of their features could be improved upon.

More particularly, installation of the measuring stops of the aforementioned patent requires some disassembly of the clamping bar, which is of course inconvenient and time consuming. Also, the main elements of the locking mechanism for those stops are integral parts of the stop body, and the constant establishment and maintenance of strong clamping forces tends to overstress and distort the material from which the body is fabricated; such distortion may inhibit full release and free sliding on the shaft, and can ultimately render the clamp completely ineffectual. Indeed, even in the absence of such overstressing the locking mechanism of the Kozyrski et al patent may not produce a sufficient clamping force to withstand the impact to which the stops are repeatedly subjected during normal operation of the machine.

Accordingly, it is the broad object of the present invention to provide a measuring stop assembly that is quickly and conventiently mounted upon the clamping bar shaft, and which affords an improved locking action while, at the same time, avoiding overstressing of the material from which the stop is constructed.

It is a related object of the invention to provide a mat cutting machine in which is employed a measuring stop having the foregoing features and advantages.

More specific objects of the invention are to provide such a measuring stop and machine in which there is no need for removal of the shaft, or other parts of the clamping bar assembly, to enable installation of the stop thereupon, and in which a favorable mechanical advantage affords a highly effective and yet simple locking mechanism.

SUMMARY OF THE INVENTION

It has now been found that certain of the foregoing and related objects of the invention are attained by the provision of a measuring stop assembly, including a body having a downwardly opening rectilinear channel for slidable seating on the clamping bar shaft. The channel of the body is defined by a substantially semicylindric bearing surface portion disposed inwardly of its longitudinal centerline, and a throat portion outwardly thereof; most desirably the width of the channel will at no point be less than a diametric dimension defining its bearing surface portion, thus permitting the clamping assembly shaft to pass readily therethrough. The locking means of the stop assembly comprises a pivot block that is mounted on the body to pivot on an axis substantially parallel to the channel centerline. The stop assembly body is so constructed as to permit such movement, and the block is so mounted as to dispose a clamping portion thereof outwardly of the channel centerline and in opposition to its bearing surface portion. Manually operated force-generating means is operatively connected to the pivot block for effecting its pivoting and for moving its clamping portion inwardly toward the channel centerline. In use, the clamping bar shaft is securely clamped between the pivot block and the bearing surface portion, thus affixing the measuring stop in any desired position along the length of the shaft.

The force-generating means will normally be mounted on a portion of the pivot block that is disposed to the opposite side of its axis of pivoting from its clamping portion. Generally, the force-generating means will be a screw engaged in a threaded aperture formed in the mounting portion of the block, and the body of the stop assembly will provide an element for receiving the screw, so as to permit it to transmit force to the pivot block.

In preferred embodiments, a lateral portion of the body of the stop assembly will have a slot in which the pivot block is mounted, permitting movement of its clamping portion into the channel of the stop body. The force-generating screw will, in such an assembly, extend through the lateral slot on an axis perpendicular to the axis of pivoting of the block, and a surface of the body defining the slot will be disposed to contact the inner end of the screw, thus providing the necessary receiving element; the outer end of the screw will have a handle to facilitate the application and release of locking force. The throat portion of the stop body channel will normally be substantially symmetric, with respect to its longitudinal medial plane, and generally of uniform width. The semicylindric bearing surface portion will desirably be asymmetric with respect to the same plane, and offset therefrom oppositely to the pivot block.

Other objects of the invention are attained by the provision of a mat cutting machine that includes a mat clamping assembly and a stop assembly, both as herein described.

DETAILED DESCRIPTION OF THE ILLUSTRATED EMBODIMENT

Figure 1:
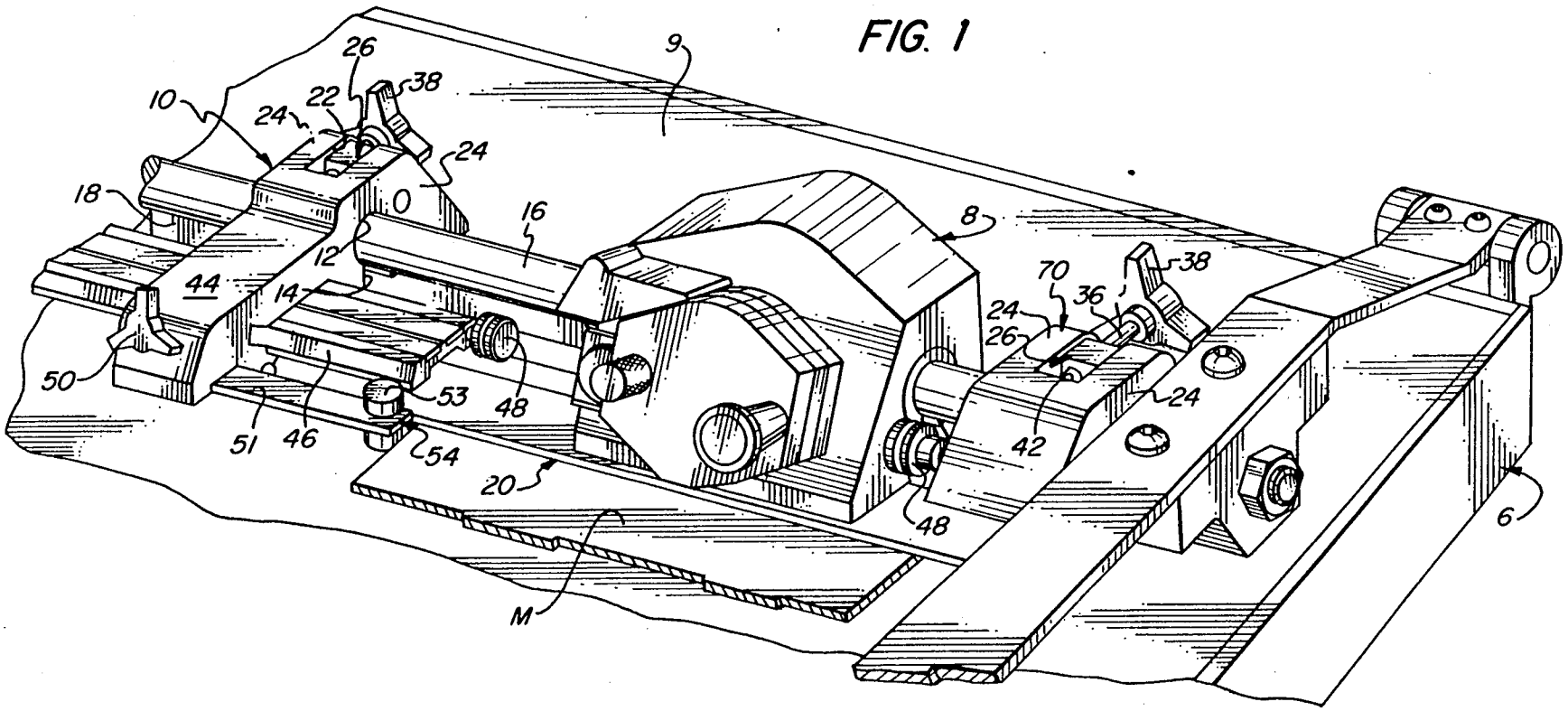
FIG. 1 is a fragmentary perspective view illustrating a mat cutting machine and measuring stop assemblies embodying the present invention.

Turning now in detail to FIG. 1 of the appended drawings, therein illustrated is a mat cutting machine, generally designated by the numeral 6, including a cutting head assembly generally designated by the numeral 8, and upper and lower measuring stop assemblies embodying the present invention. The machine 6 and cutting head assembly 8 are fully described in the aforementioned Kozyrski et al patent, and need not therefore be described in detail here.

Figure 2:
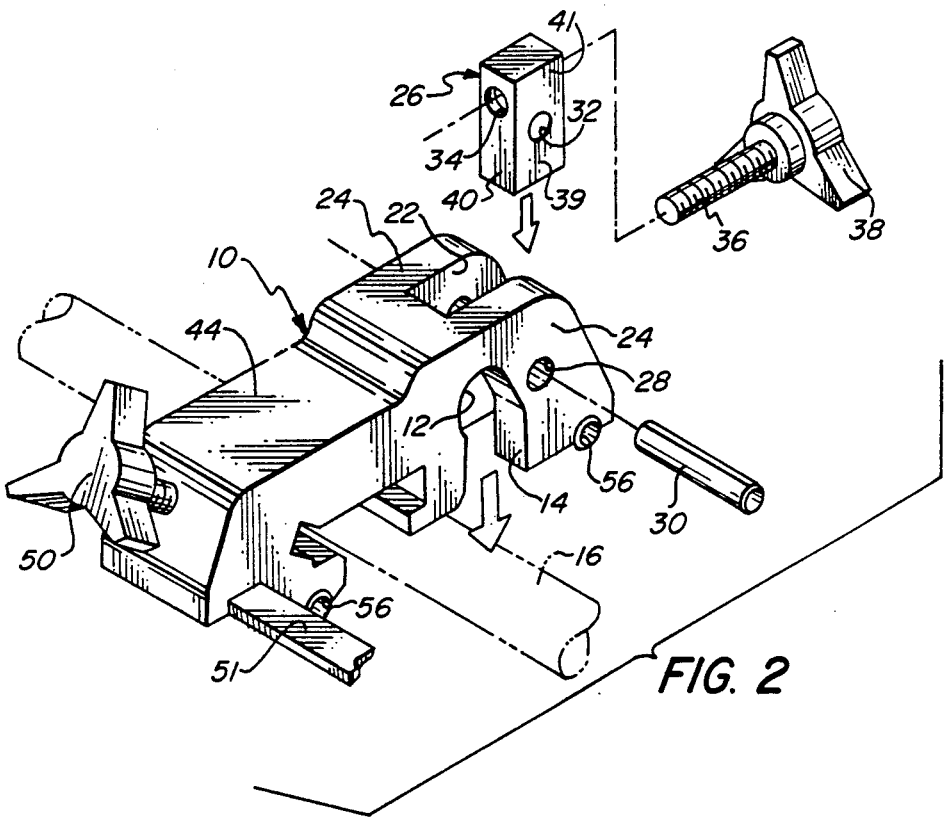
FIG. 2 is an exploded perspective view of the upper stop assembly shown in FIG. 1, drawn to a slightly enlarged scale.
Figure 3:
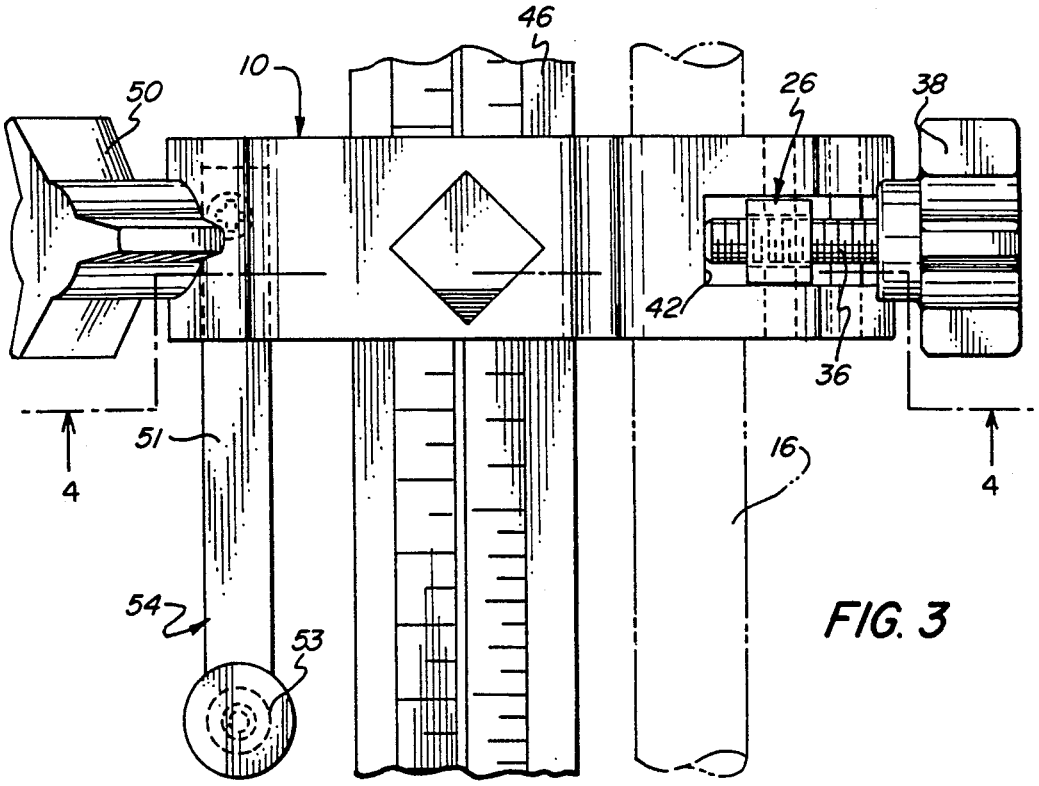
FIG. 3 is a plan view of the upper stop assembly, drawn to a further enlarged scale.
Figure 4:
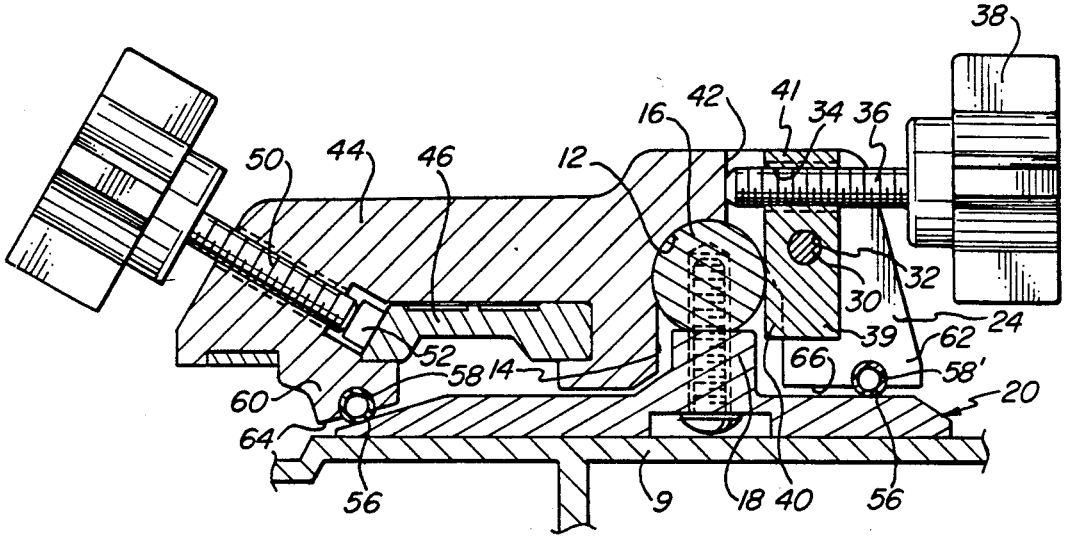
FIG. 4 is a sectional view, taken along line 4—4 of FIG. 3.
Figure 5:
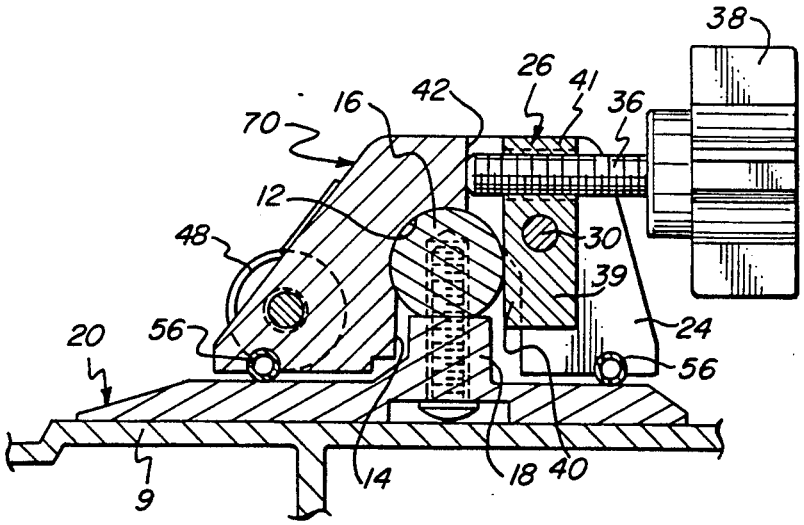
FIG. 5 is a similar view of the lower stop assembly shown in FIG. 1.

The upper stop assembly is more fully illustrated in FIGS. 2–4, and includes a body, generally designated by the numeral 10, through which extends a rectilinear channel defined by an inner, semicylindric bearing surface 12 and an outer throat portion 14. A rectilinear shaft 16 of circular cross section is affixed upon the rib portion 18 of the cutting machine clamping bar, generally designated by the numeral 20, used to hold the mat M to be cut against the base 9 of the machine. As will be noted, the shaft 16 is inserted through the throat portion 14 of the channel, and engages the bearing surface 12 to slidably seat the body 10. It can be seen that the throat portion 14 is of sufficient width, relative to the diameter of the shaft 16, to permit it to pass freely therethrough; it can also be seen that at no point is the width of the channel less than the diametric dimension defining the surface 12.

A slot 22 is formed in a lateral portion of the body 10, and communicates with the channel thereof, just described; the slot and channel are disposed on axes that are perpendicular to one another. A pair of ear portions 24 on the stop body 10 define the sides of the slot 22, and support therewithin a clamping block, generally designated by the numeral 26. The block 26 has a central bore 32 by which it is pivotably mounted upon a grooved pin 30, the opposite end portions of which pin are firmly engaged (by virtue of its grooved structure) within aligned apertures 28 formed through the ear portions 24.

Disposed transversely on the clamping block 26, to opposite sides of the bore 32, are a clamping portion 39 and a mounting portion 41. The clamping portion has a gripping element 40 aligned with the throat portion 14 of the channel through the body, and the mounting portion 41 is formed with a threaded aperture 34, extending on an axis perpendicular to that of the bore 32. The shaft 36 of a clamping screw is engaged in the aperture 34 with its inner end bearing upon an interior, slot-defining surface 42 of the body 10; the handle 38 on the outer end of the shaft 36 projects from the slot 22 for facile manipulation.

It will readily be seen that tightening of the clamping screw will produce pivoting of the block 26, urging the gripping element 40 of its clamping portion 39 inwardly of the channel throat portion 14 to bear upon the shaft 16 of the clamping bar 20. A very strong locking action will be produced due to the mechanical advantage afforded, thus enabling the measuring stop to be rigidly affixed at any selected position along the length of the shaft. The generally diametric relationship that is achieved by offsetting the bearing surface 12 and the clamping portion 39 to opposite sides of the medial plane of the channel throat portion 14 also contributes significantly to the strength of the grip exerted on the shaft 16.

Other features of the measuring stop depicted in the drawings are described in the aforementioned Kozyrski et al patent, and need not therefore be discussed in detail. Suffice to say that the body 10 includes a lateral arm portion 44, in which is slidably supported a rule 46; a stop element screw 48 is engaged within a threaded bore that extends longitudinally into the forward end of the rule body. The end of a clamping screw 50 bears upon a force-distributing contact shoe 52, which is seated within a lateral slot of the arm portion and is disposed to engage a beveled edge surface of the rule body, the arrangement serving of course to secure the rule in any selected position. The stop body 10 also carries a locating subassembly, generally designated by the numeral 54, and consisting of a spring strip 51 having a locating lug 53 affixed at one end for contacting the edge of the mat M; the opposite end of the spring 51 is seated, and appropriately secured, within a groove formed into the stop body arm portion 44.

A feature not provided by the Kozyrski et al patent comprises two tubing elements 56, which are seated within semicircular grooves 58, 58' formed into the underside of lateral bearing elements 60, 62 and protruding past the bottom surfaces 64, 66 thereof, respectively. The tubing elements slidably bear upon the corresponding upper surface portions of the clamping bar 20, thus affording smooth, drag-free movement of the measuring stop, and also enhancing stability upon the shaft 16. The tubing elements 56 will be made of a low-friction synthetic resinous material, suitably nylon.

Although not described in detail, it will be appreciated that, insofar as concerns the means for mounting and clamping it upon the shaft 16, the lower measuring stop assembly, generally designated by the numeral 70, will have substantially the same construction as the upper one. It is self-evident, however, that there is no reason to provide thereon the slidable rule or the locating lug subassembly of the upper stop.

Thus, it can be seen that the present invention provides a measuring stop assembly that is quickly and conveniently mounted upon the clamping bar shaft, and that affords an improved locking action while, at the same time, avoiding overstressing of the material from which the stop is fabricated. The construction of the stop renders it unnecessary to remove the shaft or other parts of the clamping bar to effect its installation, and the favorable mechanical advantage that the stop incorporates provides a highly effective and yet simple locking mechanism.

Having thus described the invention what is claimed is:

1. In a measuring stop assembly for a mat cutting machine, the machine having a mat clamping bar assembly with an elongated shaft of circular cross section for slidably mounting thereon a cutting head, and said stop assembly including a body with a downwardly opening channel for slidable seating of said body on the clamping assembly shaft, and locking means for affixing said stop assembly at selected points along the length of the shaft, said channel having a rectilinear longitudinal centerline and being defined by a substantially semicylindric bearing surface portion disposed inwardly of said centerline and a throat portion outwardly thereof; the improvement wherein the width of said channel is at no point less than a diametric dimension defining said bearing surface portion, to permit the clamping assembly shaft to pass through said throat portion of said channel to said surface portion, and wherein said locking means comprises a pivot block mounted on said body to pivot on an axis substantially parallel to said channel centerline, and manually operated force-generating means operatively connected to said block for effecting pivoting thereof so as to move a clamping portion of said block inwardly toward said channel centerline, said stop assembly body being so constructed as to permit movement of said clamping portion of said block into said channel, and said block being so mounted as to dispose said clamping portion to one side of said axis of pivoting and outwardly of said centerline, in opposition to said bearing surface portion, to enable clamping of the mat clamping assembly shaft therebetween.

2. The assembly of claim 1 wherein a lateral portion of said body of said stop assembly is slotted to provide a slot communicating with said channel, said pivot block being so mounted in said slot for movement of said clamping portion thereof into said channel.

3. The assembly of claim 2 wherein said pivot block has a mounting portion on which said force-generating means is mounted, said mounting and clamping portions of said block being disposed to opposite sides of said axis of pivoting thereof.

4. The assembly of claim 3 wherein said force generating means is a screw, and wherein said mounting portion of said pivot block has a threaded aperture in which said screw is engaged, said body of said stop assembly providing an element for receiving said screw so as to permit said screw to transmit force to said block.

5. The assembly of claim 4 wherein said screw extends through said slot on an axis perpendicular to said axis of pivoting, and wherein a surface of said body defining said slot provides said element for receiving said screw, the inner end of said screw bearing upon said body surface and the outer end thereof having a handle thereon.

6. The assembly of claim 1 wherein said pivot block has a mounting portion on which said force-generating means is mounted, said mounting and clamping portions of said block being disposed to opposite sides of said axis of pivoting thereof.

7. The assembly of claim 6 wherein said force generating means is a screw, and wherein said mounting portion of said pivot block has a threaded aperture in which said screw is engaged, said body of said stop assembly providing an element for receiving said screw so as to permit said screw to transmit force to said block.

8. The assembly of claim 1 wherein said throat portion of said channel is substantially symmetric with respect to a medial plane extending longitudinally therealong, and wherein said bearing surface portion is asymmetric with respect to said plane and is offset toward a side thereof opposite to that on which said pivot block is disposed.

9. In a measuring stop assembly for a mat cutting machine, the machine having a mat clamping bar assembly with an elongated shaft of circular cross section for slidably mounting thereon a cutting head, and said stop assembly including a body with a downwardly opening channel for slidable seating of said body on the clamping assembly shaft, and locking means for affixing said stop assembly at selected points along the length of the shaft, said channel having a rectilinear longitudinal centerline and being defined by a substantially semicylindric bearing surface portion disposed inwardly of said centerline and a throat portion outwardly thereof; the improvement wherein said locking means comprises a pivot block mounted on said body to pivot on an axis substantially parallel to said channel centerline, and manually operated force-generating means operatively connected to said block for effecting pivoting thereof so as to move a clamping portion of said block inwardly toward said channel centerline, said stop assembly body being so constructed as to permit movement of said clamping portion of said block into said channel, and said block being so mounted as to dispose said clamping portion to one side of said axis of pivoting and outwardly of said centerline, in opposition to said bearing surface portion, to enable clamping of the mat clamping assembly shaft therebetween.

10. The assembly of claim 9 wherein said body has bottom surface portions laterally disposed to opposite sides of said channel thereof, and wherein said stop assembly additionally includes a bearing element made of a low friction material mounted on each of said bottom surface portions and projecting therefrom.

11. The assembly of claim 10 wherein each of said bearing elements is a tubing element and wherein said bottom surface portions of said body comprise semicircular grooves with said tubing elements being seated therein.

12. In a mat cutting machine having a mat clamping bar assembly with an elongated shaft of circular cross section for slidably mounting thereon a cutting head, and a stop assembly including a body with a downwardly opening channel for slidable seating of said body on the clamping assembly shaft, and locking means for affixing said stop assembly at selected points along the length of said shaft, said channel having a rectilinear longitudinal centerline and being defined by a substantially semicylindric bearing surface portion disposed inwardly of said centerline and a throat portion outwardly thereof; the improvement wherein the width of said channel is at no point less than a diametric dimension defining said bearing surface portion, to permit said clamping assembly shaft to pass through said throat portion of said channel to said surface portion, and wherein said locking means comprises a pivot block mounted on said body to pivot on an axis substantially parallel to said channel centerline, and manually operated force-generating means operatively connected to said block for effecting pivoting thereof so as to move a clamping portion of said block inwardly toward said channel centerline, said stop assembly body being so constructed as to permit movement of said clamping portion of said block into said channel, and said block being so mounted as to dispose said clamping portion to one side of said axis of pivoting outwardly of said centerline and in opposition to said bearing surface portion, to enable clamping of said mat clamping assembly shaft therebetween.

13. The assembly of claim 12 wherein said throat portion of said channel is substantially symmetric with respect to a medial plane extending longitudinally therealong, and wherein said bearing surface portion is asymmetric with respect to said plane and is offset toward a side thereof opposite to that on which said pivot block is disposed.

14. The assembly of claim 12 wherein a lateral portion of said body of said stop assembly is slotted to provide a slot communicating with said channel, said pivot block being so mounted in said slot for movement of said clamping portion thereof into said channel.

15. The assembly of claim 14 wherein said pivot block has a mounting portion on which said force-generating means is mounted, said mounting and clamping portions of said block being disposed to opposite sides of said axis of pivoting thereof.

16. The assembly of claim 15 wherein said force generating means is a screw, and wherein said mounting portion of said pivot block has a threaded aperture in which said screw is engaged, said body of said stop assembly providing an element for receiving said screw so as to permit said screw to transmit force to said block.

17. The assembly of claim 16 wherein said screw extends through said slot on an axis perpendicular to said axis of pivoting, and wherein a surface of said body defining said slot provides said element for receiving said screw, the inner end of said screw bearing upon said body surface and the outer end thereof having a handle thereon.

* * * * *